United States Patent [19]

Jaquard et al.

[11] Patent Number: 4,922,801

[45] Date of Patent: May 8, 1990

[54] FIRE CONTROL SYSTEM WITH AIMING ERROR COMPENSATION

[75] Inventors: Paul Jaquard, Peco; Jean-Pierre Lelay, Argenteuil; Jean Doreau, Vigny, all of France

[73] Assignee: Societe d'Applications Generales d'Electricite et de Mecanique Sagem, Paris, France

[21] Appl. No.: 387,771

[22] Filed: Aug. 1, 1989

[30] Foreign Application Priority Data

Aug. 12, 1988 [FR] France ..... 88 10862

[51] Int. Cl.[5] ..... F41G 3/08; G06F 15/58

[52] U.S. Cl. ..... 89/41.05; 235/412; 364/423; 89/41.22

[58] Field of Search ..... 89/41.05, 41.06, 41.07, 89/41.21, 41.22; 235/411, 412, 413; 364/423; 358/104, 46, 107, 125, 126

[56] References Cited

U.S. PATENT DOCUMENTS 4,020,324 4/1977 Buscher et al. ..... 89/41.21
4,038,521 7/1977 Baumann et al. ..... 89/41.22
4,312,262 1/1982 Tye ..... 235/412
4,318,361 3/1982 Hausenblas ..... 89/41.05
4,570,530 11/1983 Bagnall-Wild et al. ..... 89/41.05
4,606,256 8/1986 De'Ath ..... 89/41.09

FOREIGN PATENT DOCUMENTS 2077400 12/1981 United Kingdom ..... 89/41.21

*Primary Examiner*—Charles T. Jordan
*Assistant Examiner*—Michael J. Carone
*Attorney, Agent, or Firm*—Larson and Taylor

[57] ABSTRACT

A fire control system for a weapon having an operator-aimed barrel comprises a sighting piece carried by the barrel and having a reticle adjustable in position with respect to the bore axis of the barrel. A camera fast with the barrel has a field coaxial with the bore axis. The apparent movement of the target in the field of the camera is measured as well as the angular movements of the barrel by the operator. The position to be given to the reticle is computed from variations of the aiming direction of the barrel and from the apparent movement and the position of the reticle is consequently adjusted. The reticle may consist of a LCD.

7 Claims, 2 Drawing Sheets

FIRE CONTROL SYSTEM WITH AIMING ERROR COMPENSATION

BACKGROUND OF THE INVENTION

1. Technical Field

The invention relates to fire control systems for a weapon having a barrel which can be aimed by an operator.

It is particular suitable in systems comprising a weapon or several mutually coupled weapons, of small or medium caliber.

2. Prior Art

Fire control systems are known (U.S. Pat. No. 4,020,324 to Buscher) of the type having a sighting piece carried by the barrel of the weapon, whose reticle is movable with respect to the bore axis of the barrel, with means for assessing the offset angle and controlling the position of the reticle. The offset angle, i.e. the angle between the direction of the reticle and the axis of the weapon (direction of fire), is determined so that, if the reticle is aligned with the present or actual target, the weapon is aimed towards a "future target". The offset angle is computed by taking into account the angular velocity of the target, the speed of the ammunition round or bullet and the assessed distance between the target and the weapon. The distance between the target and the weapon is generally estimated or measured, while the speed of the ammunition round is stored in a memory. The angular speed of the target with respect to a fixed reference point is assumed to be equal to the angular speed of the weapon controlled by the gunner who holds it aimed at the target. Due to that assumption, measurement of the angular speed of the target is affected by noise due to the aiming errors by the gunner and possibly to instabilities of the support.

SUMMARY OF THE INVENTION

It is an object of the invention to provide a fire control system with an improved determination of the offset angle to be given to the reticle, the latter term being used for designating not only an ocular sighting reference but also a reference taking into account by an automatic fire control system automatically aiming a weapon from plotting of the trajectory of the target.

To this end, there is provided a system of the above-defined type further comprising a wide field camera fast with the weapon barrel, means for measuring the apparent movement of the image of the target in the field of the camera and for computing the offset angle from angular variations of the aiming direction of the weapon barrel measured by sensors, for example tachometric or gyrometric sensors, and from the apparent movement of the image in the field of the camera.

Thus a function is provided equivalent to that of a stabilized remote aiming control station operating as a master station for a weapon system, but in a much simpler way. Measurement of the apparent movement in the field of the camera simply gives a corrective term, i.e. a minor correction of the aiming direction removing the noise caused by the incapacity of the gunner to permanently and accurately follow the movement of the target. In other words, the trajectory plot of the target becomes independent of the quality of tracking the target. Filtering for minimizing the influence of aiming errors may be simplified.

Furthermore, coupling between aiming and introduction of the fire correction term is without effect on the calculation of the latter.

The invention also provides a fire installation having a range finding capacity while only using simple means. For that, the invention uses a wide field camera (which may be the same camera as used for measuring the aiming error) and means for measuring the apparent diameter of the target image in the field of the camera. A simple process makes it possible to determine the distance of the target from the apparent diameter of the target, the value of the focal length of the camera and the actual preset dimensions of the target.

A camera using a matrix of charge coupled sensors (less expensive than a "Vidicon" camera) may be used for implementing the invention. This camera may, for night use, be coupled to a light intensifying tube. The system can then be used not only by day but also by night.

It is important to note that range measurement may be permanently maintained, provided that the target remains in the field of the camera. The camera need not be aimed exactly at the target, while it is necessary in the case of a narrow angle telemeter for example.

It is still another object of the invention to provide a movable reticle for fire control systems, making it possible to define the aiming direction for the gunner accurately using only simple means.

For that, the invention provides a fire control system with a sighting piece whose reticle is formed by a liquid crystal matrix display, making it possible to give a particular brightness to at least one pixel.

The matrix may also be used for displaying the image as seen by a wide angle camera, such as that required for the above-mentioned functions, to the gunner. This use is of particular interest when the camera is suitable for operating with a low light level, for example when it uses a light intensifier or a "NOCTICON" matrix of sensitive elements: night firing becomes then possible.

The invention will be better understood from the following description of a particular embodiment given by way of non limitative example. The description refers to the accompanying drawings.

DETAILED DESCRIPTION OF A PREFERRED EMBODIMENT

Figure 1:
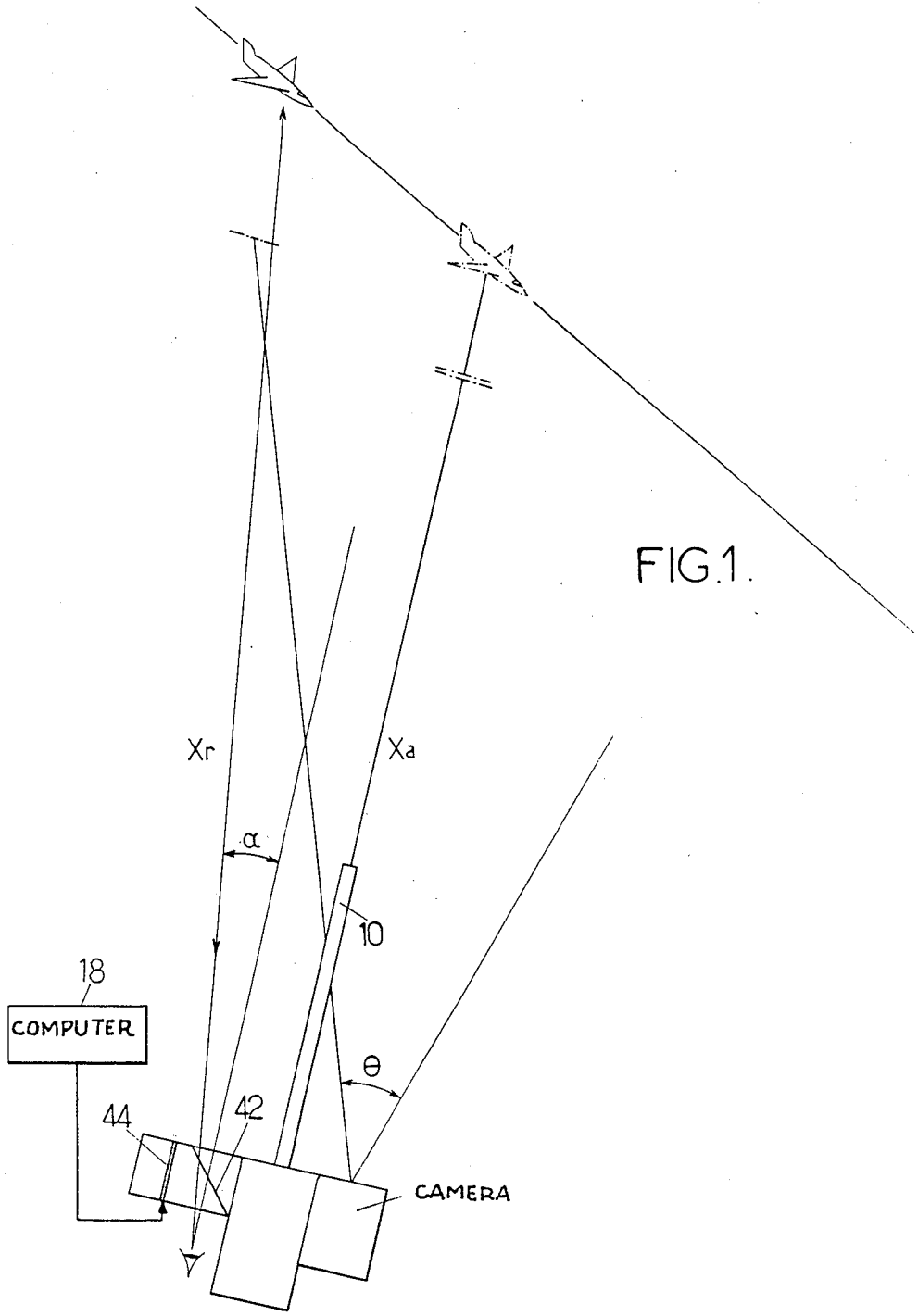
FIG. 1 is a general diagram showing the parameters which are used for implementing the invention.
Figure 2:
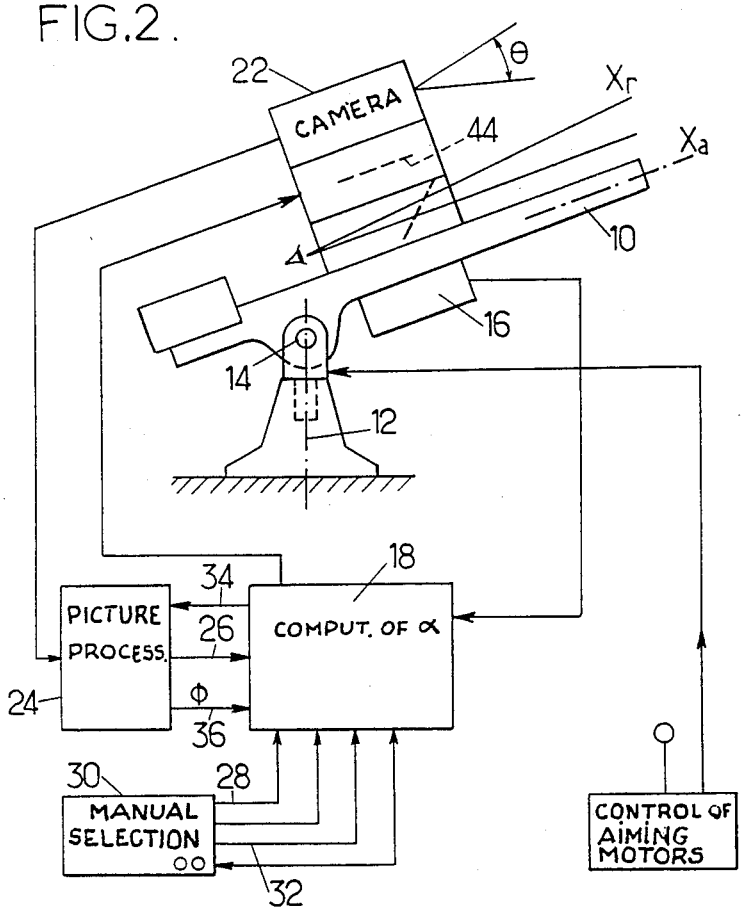
FIG. 2 is a block diagram showing the main components of a system according to the invention.

The aiming system shown schematically in FIGS. 1 and 2 is intended for a small caliber weapon 10, such as 20 mm twin guns, with manual aiming by rotation about a bearing axis 12 and an elevation axis 14. Axis Xa of the weapon (i.e. the firing direction) must not be directed towards the instantaneous position of the target at the time of firing, which will be called "actual target", but towards the position which the target will have when the ammunition is closest, i.e. towards a "future target" indicated with broken lines in FIG. 1. For easier aiming by the gunner, the sighting high piece fixed to the weapon is provided with means for offsetting the reticle in a direction and by an amount such that, when the sighting axis Xr is aligned with the actual target, the axis Xa of the weapon barrel is aligned with the future target. The use of offset means requires estimating or computing the offset angle $\alpha$ between Xr and Xa, and the direction of the offset.

The means shown in FIGS. 1 and 2 for defining the amount and direction of $\alpha$ comprise a unit for measuring the aiming angle (or the speed of variation thereof) and a camera equipped with an error measuring device. The measuring unit 16 may be of conventional construction. As shown in FIG. 2, it is carried by the weapon and may comprise for example two gyrometers which permanently supply angles or speeds to a computing unit 18. When the mount of the weapon is perfectly stationary, tachometric or angular sensors may be used instead of gyrometers.

Figure 3:
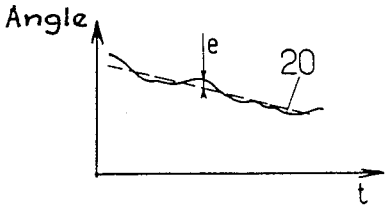
FIG. 3 is a diagram showing an example of variation of the direction of weapon aimed at a target, in a fixed reference system, as a function of time, and showing the aiming error computed by analyzing the image supplied by a camera secured to the barrel of the weapon.

Due to the imperfections and time constants of the system for motorizing the mount and due to the limitations inherent in manual aiming, tracking of a target whose angular position varies in time as shown by a straight line in FIG. 3, may be represented by an irregular line, such as line 20. In a conventional system, the influence of the aiming error is reduced by low-pass filtering of the signal, which is not without drawbacks. The system of the invention as shown in FIGS. 1 and 2 overcomes this requirement. For that, it comprises a camera 22 carried by the weapon barrel and whose field $\theta$ is coaxial with the direction of the weapon barrel (fire direction). The field of the camera must be sufficient for the actual target not to leave it, even when the distance between the actual target and future target is maximum.

The video signal delivered by camera 22 is applied to an image processing circuit 24. An object of circuit 24 is to provide, at an output 26, the characteristics (modulus and angle) of the position and of the speed of the target image in the field, i.e. data of optical measurement.

By combining the speed or position measurements delivered by unit 16 and by circuit 24, as well as an indication of target range, the computing unit 18 determines angle $\alpha$ (FIG. 1). The range may be input manually to the computing unit from an output 28 of a console 30. It may also be provided by the image processing circuit 24, as will be seen further on: the console 30 may then comprise an output 32 for selecting the operating mode, permitting the computing unit 18 to take into account either a preset distance from the console or a range delivered by the image processing circuit.

It will often be useless to assist the image processing circuit by indicating the target image in the field manually. In fact, the computing unit 18 may deliver to the image processing circuit 24, over a channel 34, an approximate indication of the position where the target will be found in the field, which allows discrimination.

The image processing circuit 24 may be designed for analysing the image of the target, extracting therefrom its geometric dimensions (apparent diameter) and delivering them to the computing unit 18 through an output 36. It is then sufficient to store, in the computing unit, typical target dimensions, for different angular positions in which they may appear, so that the computing unit has available the elements required for range finding. A few typical dimensions are sufficient. It is consequently enough to provide a target manual selector on console 30.

Reticles of very various kinds may be used; however, in an advantageous embodiment of the invention, the reticle comprises a matrix of display elements, typically a liquid crystal matrix. To make the reticle appear, the arrangement shown schematically in FIG. 1 may be used. A semi-reflecting mirror 42 makes it possible to superimpose the image of the actual target and the pattern delivered by matrix 44. The computing unit 18 energizes at least one line and one column of the matrix, so as to cause two bright crossed lines to appear, or energizes a pixel. The arrangement may be reversed, so that the reticle appears in black on a white background. Contrast reversal may be provided by modifying the control of the matrix or inverting the direction of a polarizer used with the liquid crystal matrix display. The computing unit computes the position of the column and of the line to be energized. It is of particular advantage to energize two lines 48 and two columns 50 so as to form a rectangular reticle which can be used for a range assessment by the gunner.

Figure 4:
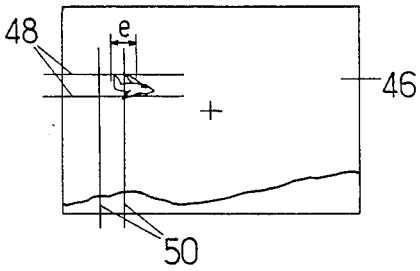
FIG. 4 is a diagrammatic view of a picture showing the image delivered by a monitor associated with the television camera carried by the barrel of the weapon.

It is also possible, particularly for night firing, to use a light intensifying camera and then to use the matrix to display the reticle and the image delivered by the camera (FIG. 4). Night firing is thus made possible.

Numerous modifications of the invention are possible. Two orthogonal strips may for example be used, instead of a matrix addressable by lines and columns; for time multiplexing of the control circuit without loss of contrast, the matrix may comprise transistors for storing the energization between two write-in operations.

We claim:

1. A fire control system for a weapon having an operator-aimed barrel, comprising:
   - a sighting piece carried by the barrel and having a reticle adjustable in position with respect to the bore axis of the barrel, a camera fast with said barrel and having a field coaxial with said bore axis,
   - means for measuring the apparent movement of an image of a target in the field of the camera,
   - means for measuring angular movements of said barrel as controlled by said operator,
   - means for computing a position to be given to said reticle from variations of the aiming direction of the barrel provided by said angular movement measuring means and from said apparent movement,
   - and means for controlling the position of the reticle with respect to the direction of the bore axis responsive to an indication of position provided by said computing means.

2. A fire control system according to claim 1, wherein said means for measuring the angular movements of the barrel comprise tachymetric or gyrometric sensors.

3. A fire control system according to claim 1, comprising a supplemental large field camera, means for measuring a size of said image of the target and additional computing means for computing, from the apparent size of the target, from the focal length of the camera and from stored dimensions of the target, the distance of the target.

4. A fire control system according to claim 1, further comprising means for measuring an apparent size of the target in the field of the camera, means for storing an actual size of typical targets, means for selecting one of said actual sizes, and range finding means for computing the distance of the target imaged by the camera from the apparent size of the target, the focal length of the camera and said actual dimensions.

5. A fire control system according to claim 1, wherein said reticle consists of a liquid crystal matrix display having means for energizing at least one line and one column of the matrix.

6. A fire control system according to claim 1, wherein said reticle consists of a liquid crystal display having means for energizing at least one pixel of said matrix.

7. A fire control system according to claim 5, wherein said camera has a light intensifier tube and said system further comprises means for displaying the image of the field of the camera by selected energization of pixels of the matrix.

* * * * *